US006587013B1

(12) United States Patent
Arlin et al.

(10) Patent No.: US 6,587,013 B1
(45) Date of Patent: Jul. 1, 2003

(54) RF POWER COMBINER CIRCUIT WITH SPACED CAPACITIVE STUB

(75) Inventors: Steven Arlin, Chelmsford; Thomas J. Casale, West Newbury, both of MA (US)

(73) Assignee: Signal Technology Corporation, Danvers, MA (US)

( * ) Notice: Subject to any disclaimer, the term of this patent is extended or adjusted under 35 U.S.C. 154(b) by 0 days.

(21) Appl. No.: 09/505,134

(22) Filed: Feb. 16, 2000

(51) Int. Cl.[7] ..... H01P 5/12

(52) U.S. Cl. ..... 333/101; 333/103; 333/105; 333/125

(58) Field of Search ..... 333/101, 103, 333/104, 105, 106, 125, 128

(56) References Cited

U.S. PATENT DOCUMENTS

| | | | | |
|---|---|---|---|---|
| 4,070,637 A | * | 1/1978 | Assal et al. | 333/105 |
| 4,463,326 A | | 7/1984 | Hom | 333/128 |
| 4,673,899 A | | 6/1987 | Jespersen et al. | 333/137 |
| 4,835,496 A | | 5/1989 | Schellenberg et al. | 333/128 |
| 4,893,093 A | | 1/1990 | Cronauer et al. | 330/295 |
| 4,916,410 A | | 4/1990 | Littlefield | 330/295 |
| 4,968,958 A | | 11/1990 | Hoare | 333/128 |
| 5,021,755 A | | 6/1991 | Gustafson | 333/128 |
| 5,132,641 A | | 7/1992 | Khandavalli | 330/295 |
| 5,164,689 A | | 11/1992 | Plonka | 333/128 |
| 5,187,447 A | | 2/1993 | Tsai | 330/644 |
| 5,264,810 A | | 11/1993 | Sager et al. | 333/131 |
| 5,285,176 A | | 2/1994 | Wong et al. | 333/137 |
| 5,313,174 A | | 5/1994 | Edwards | 333/109 |
| 5,349,313 A | | 9/1994 | Collins et al. | 333/131 |
| 5,576,671 A | | 11/1996 | Agar, Jr. et al. | 333/128 |
| 5,662,816 A | | 9/1997 | Andry | 216/18 |
| 5,668,510 A | | 9/1997 | Humpherys | 333/127 |
| 5,712,592 A | | 1/1998 | Stimson et al. | 330/124 |
| 5,767,755 A | | 6/1998 | Kim et al. | 333/101 |
| 5,790,517 A | | 8/1998 | Meredith | 370/210 |
| 5,796,317 A | | 8/1998 | Bohlman et al. | 333/127 |
| 5,831,479 A | | 11/1998 | Leffel et al. | 330/124 |
| 5,867,060 A | | 2/1999 | Burkett, Jr. et al. | 330/2 |
| 5,872,491 A | | 2/1999 | Kim et al. | 333/101 |
| 5,880,648 A | | 3/1999 | Aves et al. | 333/127 |

FOREIGN PATENT DOCUMENTS

| | | |
|---|---|---|
| JP | 10200313 | 7/1998 |

* cited by examiner

*Primary Examiner*—Justin P. Bettendorf
(74) *Attorney, Agent, or Firm*—George A. Herbster

(57) ABSTRACT

An RF power combiner. A plurality of RF inputs connect to a power combiner switch assembly. RF switches connect each input to a common node. A single stub matching circuit connects between the common node and an output node such that an open-ended transmission line stub extends from the output node. An RF output connector feeds an RF output connection from the output node. The stub of the L-match circuit has fixed length or variable length configurations. As a consequence, the impedances at the common and output nodes are more closely matched.

13 Claims, 11 Drawing Sheets

RF POWER COMBINER CIRCUIT WITH SPACED CAPACITIVE STUB

BACKGROUND OF THE INVENTION

1. Field of the Invention

This invention generally relates to RF communications and more specifically to an N-way combiner that facilitates the control of a transmitted RF signal.

2. Description of Related Art

Wireless RF applications, particularly in the 800 to 1000 MHz and 1900 to 2400 MHz ranges, have become wide spread in recent years. These are frequencies of choice for wireless telephones and similar devices. Particular effort has been directed to the development of the high-power RF transmitting facilities for such applications including wireless telephone repeaters.

Many of these applications include multiple amplifiers to provide an appropriate RF output power. For example, a 600 watt transmitting facility may include four 150 watt transmitters operating in parallel, rather than a single 600 watt transmitter. Using lower powered amplifiers provides reliability through redundancy and in many cases reduces costs as the cost of several lower powered RF amplifiers may be less than the cost of a single high powered amplifier. Moreover, the use of lower powered amplifiers allows different sites to be configured at different power levels without requiring different amplifiers. For example, a single amplifier could be used to provide a 150 watt transmitting facility; two amplifiers, a 300 watt transmitting facility; etc.

However, a single, high powered transmitter is characterized by simplified impedance matching to an antenna or other RF load. Generally the impedance match remains essentially the same for a given frequency regardless of the power being transmitted. With parallel, identical, lower powered amplifiers, however, the problem becomes more difficult because the output impedance of the collective amplifiers will be $Z_0/N$ where $Z_0$ is the characteristic impedance of one amplifier and N is the number of amplifiers operating in parallel. Thus, the impedance at a common node for a four-amplifier transmitting facility will vary between 50 ohms and 12-½ ohms depending upon the number of amplifiers operating in parallel. If the impedance is not well matched, VSWR and insertion losses increase.

A number of power dividers and combiners have been proposed for minimizing the effects of impedance mismatches. Generally in these systems a single RF source produces an RF signal that divides into equi-phase, equi-amplitude input signals to parallel amplifiers. The combiner section then recombines the four amplified outputs to produce the high powered RF output signal. One particular approach, known in the art as a Wilkinson circuit, uses transmission lines at a characteristic impedance to convey signals to different ports. The ports are tied through resistors to a common node. The transmission lines may be anywhere from a quarter wavelength ($\lambda/4$) to a half wavelength ($\lambda/2$) in length. In such systems, however, optimal performance occurs when all parallel paths are energized. Insertion losses when only one amplifier is operating can become 75% of the input. With these losses it can be seen, particularly if equal amplitudes and phases are not maintained, that significant heat will be generated. In systems using resistors, this heat can lead to circuit failure.

U.S. Pat. No. 4,893,093 (1990) to Cronauer et al. discloses a switched, power splitter in which a high frequency input signal is applied to a plurality of amplifiers. First transmission lines connect between the input and each of the amplifiers with each transmission line capable of being switched between a high level and a low level of impedance. A balanced resistor network is preferably coupled between the first transmission lines. Second transmission lines shunt across the first transmission lines and the impedance of each second transmission line can be altered to a predetermined percentage of the circuits input impedance. A control circuit switches the various transmission lines so that the impedance of the antenna remains balanced no matter how many of the first transmission lines are in the high impedance state.

U.S. Pat. No. 5,767,755 (1998) to Kim et al. discloses another embodiment of a power combiner with a plurality of transmission lines connecting a plurality of inputs to an output terminal. RF switches provide the selection of up to N channels as active channels. The electrical length from each RF switch to the output terminal is preferably one-half wavelength at a central frequency (i.e., $\lambda/2$ at $f_0$). When a switch is on, the signal power applied to all of input terminals is combined at the output terminal. When the switch is off, the RF power incident to the switch is reflected and the transmission line connected between that switch and the output terminal appear as an open circuit. However, it does appear the output impedance at the combined circuit can vary over a range of 4:1.

U.S. Pat. No. 5,867,060 (1990) to Burkett, Jr. et al. discloses still another embodiment of a power combiner that will allow the selection of a number of amplifiers operating in parallel for driving a load having characteristic impedance. Each amplifier connects to a common node through a phasing line one half-wavelength at the characteristic impedance. A quarter wavelength transforming line then connects the common node to the load. This transforming line has an impedance that depends upon the number of circuits being energized simultaneously. Therefore it appears that in this system a wide range of mismatches can still occur.

U.S. Pat. No. 5,872,491 (1999) to Kim et al. disclose a Wilkinson-type power divider/combiner that has a selective switching capability. The switchable power divider/combiner includes N first switches connecting N input/output transmission lines to a common junction and N second switches connecting N isolation resistors coupled to the N input/output transmission lines to a common node. The activation of each pair of the first and second switches to a closed or opened switch position controls the operating mode. Optimal impedance matching is provided by adjusting the impedance values to provide optimal impedance matching in both N-way and (N−1)-way operating modes. While this system appears to optimize for a particular configuration in anticipation of a failure of one path, it does not appear readily adapted for providing optimal impedance if more than one channel becomes inactive.

Examination of each of the foregoing patents and other representative prior art indicates that each of the approaches is overly complex. Problems of heating, insertion losses and impedance mismatches continue to exist. What is needed is a power combiner that can provide good VSWR and insertion loss characteristics over a wide range of input powers.

SUMMARY

Therefore it is an object of this invention to provide an RF power combiner that is simple to construct and cost effective.

Another object of this invention is to provide an RF power combiner that exhibits a low VSWR for a wide range of operating power.

Still another object of this invention is to provide an RF power combiner that exhibits low insertion losses for a wide range of operating power.

In accordance with one aspect of this invention, a power combiner provides a plurality of RF input connections and an RF output connection. Switched RF feed lines connect each RF input connection to a common node. An RF output conductor connects the RF output connection to an output node. An impedance matching network connects to the common and output nodes and includes capacitive stub means connected to the output node.

In accordance with another aspect of this invention, a power combiner can produce at an RF output connection the combined outputs of up to four RF inputs in response to remotely generated selection signals. A transmission line and RF input switch connect in series between each RF input connection and a common node with said RF input switch being proximate the common node. An RF transmission line connects an output node to the RF output connection. A single stub matching circuit connects to the common and output nodes thereby to establish an impedance transformation function between the common and output nodes.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
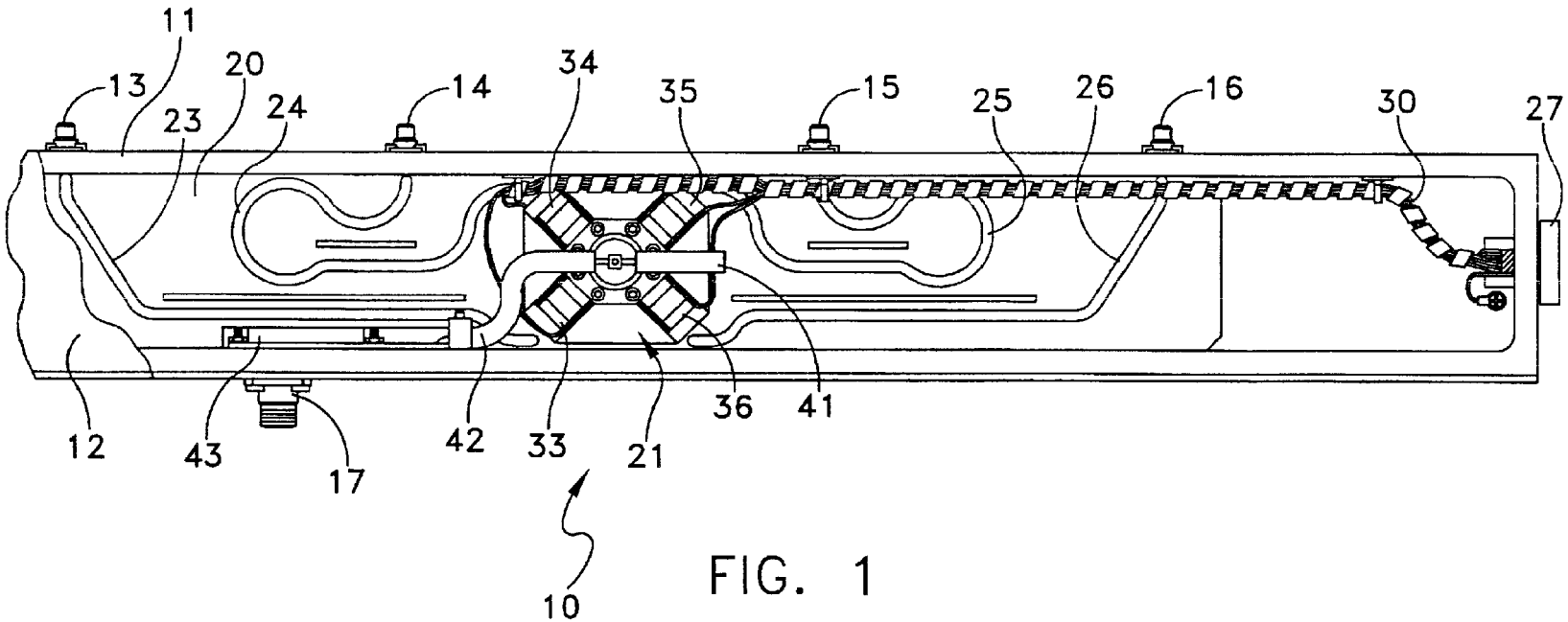
FIG. 1 is a plan view of one embodiment of a power combiner constructed in accordance with this invention.

FIG. 1 depicts one embodiment of this invention in the form of a power combiner 10 mounted in a chassis 11 typically enclosed by a cover 12 that is partially shown. The chassis 11 carries four RF input connections 13, 14, 15 and 16. One or more RF transmitters, up to a maximum of four RF transmitters in this particular embodiment, connect to different ones of the RF input connections 13 through 16. The chassis 11 also carries an RF output connection 17.

A PC board 20 mounts in the chassis 11 and carries a number of components that are used in the power combiner 10 and particularly in a power combiner switch assembly 21. The printed circuit board includes transmission lines 23, 24, 25, and 26 formed as microstrips, or as like transmission lines, having a characteristic impedance (e.g., $Z_0$ =50 ohms). Each of these transmission lines has an equal length to prevent any phase errors in the signals arriving at the power combiner switch assembly 21. A terminal block 27 provides a connection to an external control mechanism that can remotely select which of a plurality of RF switches in the power combiner switch 21 will be conductive and which will be non-conductive. A cable 30 conveys the selection signals to the solenoids of individual RF switches at the power combiner switch assembly 21.

Figure 2:
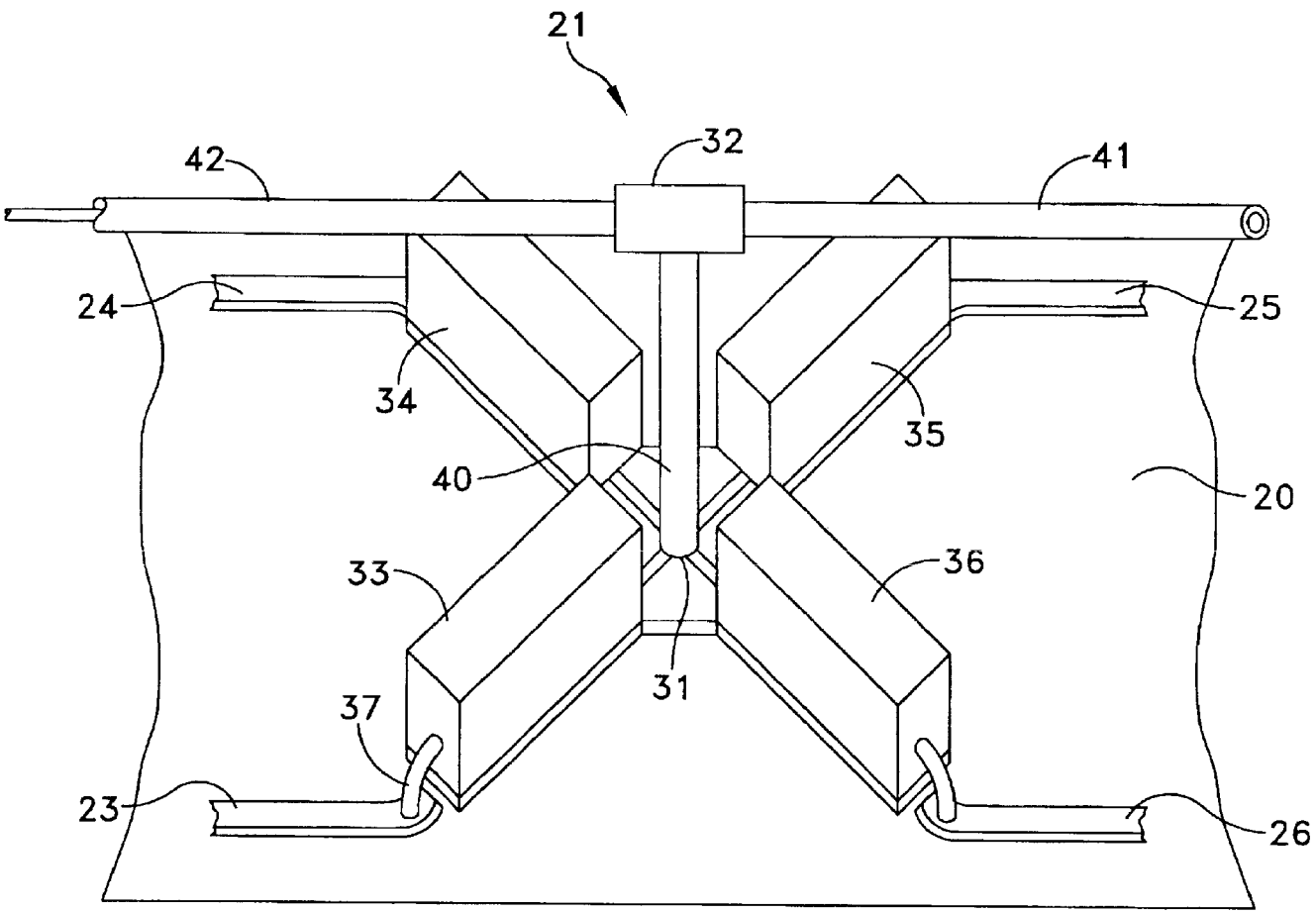
FIG. 2 is a perspective view of a power combiner switch assembly constructed in accordance with one embodiment of this invention.
Figure 3:
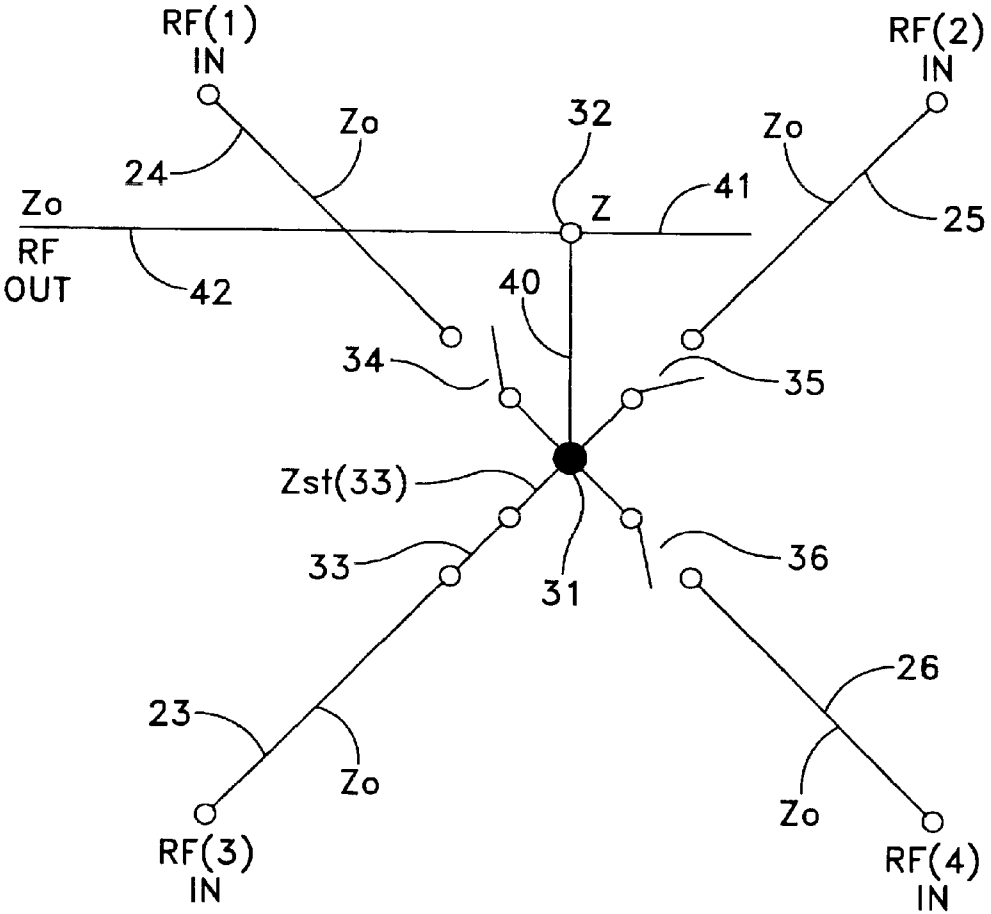
FIG. 3 is an electrical schematic diagram of the power combiner switch assembly shown in FIGS. 1 and 2.

Referring to FIGS. 1, 2 and 3, the power combiner switch assembly 21 in this particular embodiment includes a common node 31 and an output node 32. RF input switches 33 through 36 are equiangularly spaced about an axis through the common and output nodes 31 and 32 and connect individually to the transmission lines 23 through 26, respectively. Thus, a combination of a transmission line and its respective RF switch, such as the transmission line 23 and RF switch 33, form an RF feed line. All the RF feed lines attach to the common node 31.

FIG. 2 depicts a connection between one RF switch 33 and its respective transmission line 23 through a conductor 37. This connection is depicted for explanation purposes only. Any of a number of well known approaches will provide such a transmission line-to-switch connection.

For any specific application, one, two, three or all the RF switches 33 through 36 can be closed. Impedance matching for these widely divergent applications is provided by an impedance matching network between the common node 31 and the output node 32. This network is preferably in the form of a single stub matching circuit that includes a transmission line 40 of predetermined length between the common and output nodes 31 and 32 and an open-ended transmission line 41 that extends from the output node 32 and acts as a stub.

An output transmission line 42 connects between the output node 32 and an output coupler 43. This provides an output signal at the output RF connection 17.

Referring particularly to FIG. 3, it will be apparent that the impedance at the common node 31 can vary by 4:1. That is, assuming that each of the paths represented by the transmission lines 23 through 26 and the corresponding switches 33 through 36. Each of these switches is shown as a single-pole switch and each switch has a characteristic impedance $Z_0$ =50 ohms, the input impedance will be 50 ohms if one of these switches 33 through 36 is conductive; 25 ohms if two of the RF switches 33 through 36 are conductive; 16.7 ohms if three of the RF switches 33 through 36 are conductive; and 12.5 ohms if all four of the RF switches 33 through 36 are conductive. Thus, the impedance mismatch with 50 ohms or other characteristic impedance, increases as the number of concurrently conductive RF switches increases.

The embodiment in FIGS. 1 through 3 assumes that applications with 3 or 4 active RF inputs require the most stringent impedance matching. The mean impedance for these two cases is 14 ohms. As previously indicated, impedance matching is provided by a single stub matching circuit that includes the transmission line 40 and open circuit transmission line 41 that acts as a capacitive stub.

Figure 4:
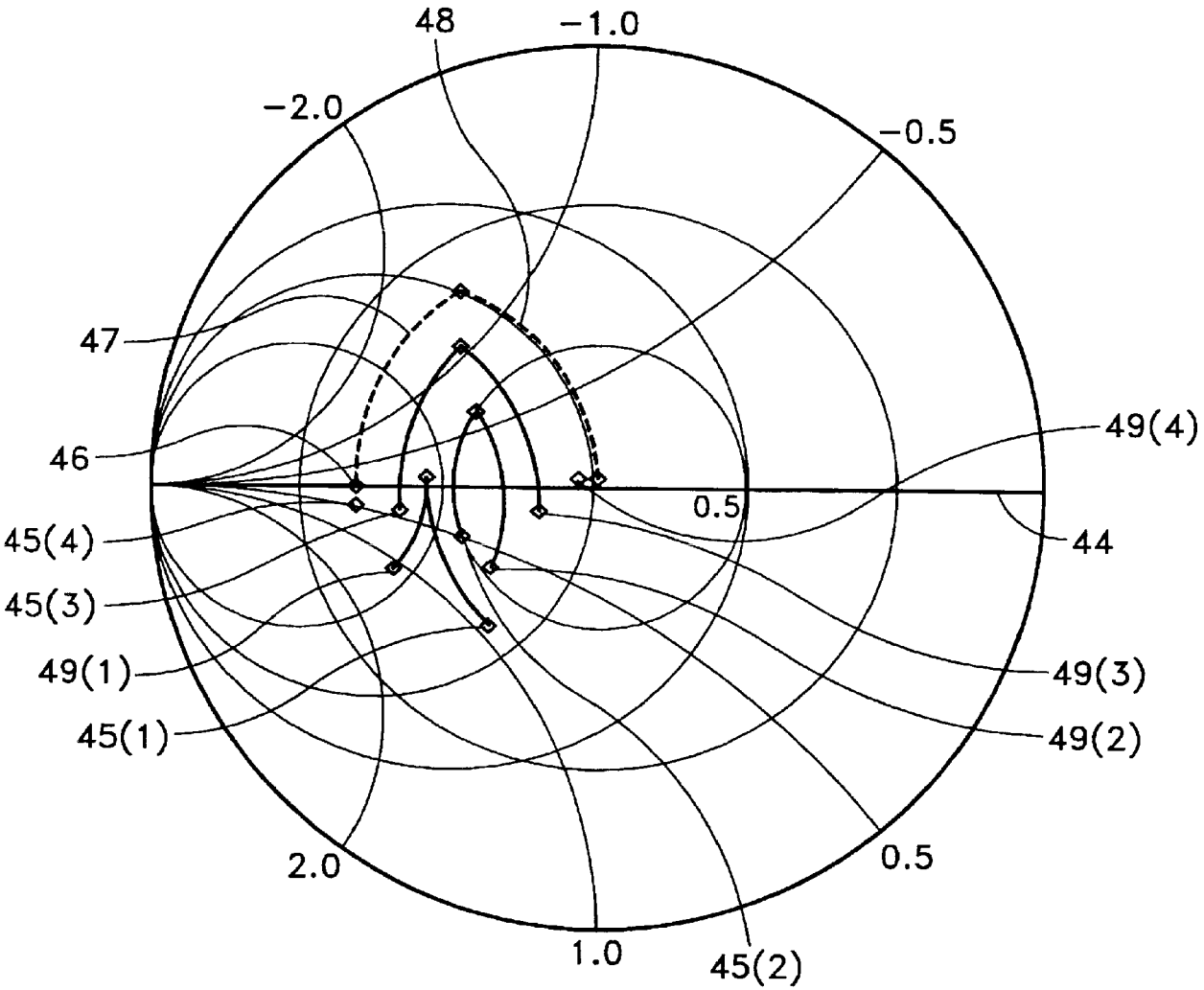
FIG. 4 is a Smith chart that depicts the operation of the power combiner shown in FIGS. 1 through 3.

FIG. 4 is a Smith chart with a real axis 44. Points 45 (1) through 45 (4) represent the actual input impedance at the common node 31 when one through four of the RF input switches are energized. A point 46 represents the mean impedance for operating conditions when either three or four RF input switches are closed. In this embodiment, point 46 is used to determine the lengths of the transmission lines 40 and 41 in the single stub matching circuit.

More specifically, arc 47 represents a phase delay introduced by the transmission line 40; arc 48, the phase shift introduced by the transmission line 41. The process for selecting specific values for these lengths is well known in the art. For this particular embodiment, the relative lengths are chosen so that the transmission line 40 introduces a phase delay of 28°; the transmission line 41, a leading phase shift of 52°. As a result the single stub matching circuit provides an impedance match between the common and output nodes for this assumed impedance at the common node 31.

As will be apparent from FIG. 4, each of the initial points 45(1) through 45(4) indicate that the actual impedance at the common node 31 has a capacitive component that increases as the number of active RF input switches decreases. This capacitive component exists because there is a finite conductor length between the common node 31 and each RF input switch terminal proximate the common node 31. When an RF input switch is open, that finite conductive length acts as a capacitive stub. When only one RF input switch is closed, then there are three capacitive stubs; and the total capacitance is the sum of the values for each stub.

In FIG. 4, end points 49(1) through 49(4) depict the effect of the single stub matching circuit. Point 49(4) is closely adjacent the end point for the nominal 14 ohm load. Arcs corresponding to arcs 47 and 48 are not shown with respect to this condition because they would superimpose on most of the arcs 47 and 48. In general, however, the use of the single stub matching circuit enhances the impedance match for each operating mode. As will be apparent from the Smith Chart and as has been demonstrated with actual measurements, the opertional characteristics of the power combiner shown in FIGS. 1 through 3 are:

| Number of Conductive Inputs | VSWR | Insertion Loss |
|---|---|---|
| 4 | <1.25:1 | <0.5 dB |
| 3 | <1.25:1 | <0.5 dB |
| 2 | <2:1 | <0.8 dB |
| 1 | <4:1 | <2.2 dB |

FIGS. 5 through 8 depict an alternative embodiment that meets more stringent requirements that may be imposed on a power combiner such as shown in FIGS. 1 through 3, in certain applications. As previously stated, the embodiment shown in FIGS. 1 through 3 assumes that an open RF feed line, that is one in which the RF switch is non-conductive, acts as an infinite impedance at the common node 31. However, there is a conductive path of a finite length from the common node 31 to a terminal in the RF input switch that can act as a short stub. The embodiment in FIGS. 5 through 8 minimizes the length of such conductive paths. It also provides a tunable or variable length transmission line 41A.

FIGS. 5 through 8 use like reference numerals to denote the same components as shown in FIGS. 1 through 3. If the elements are modified they are designated by the same reference numeral with a suffix "A".

Figure 7:
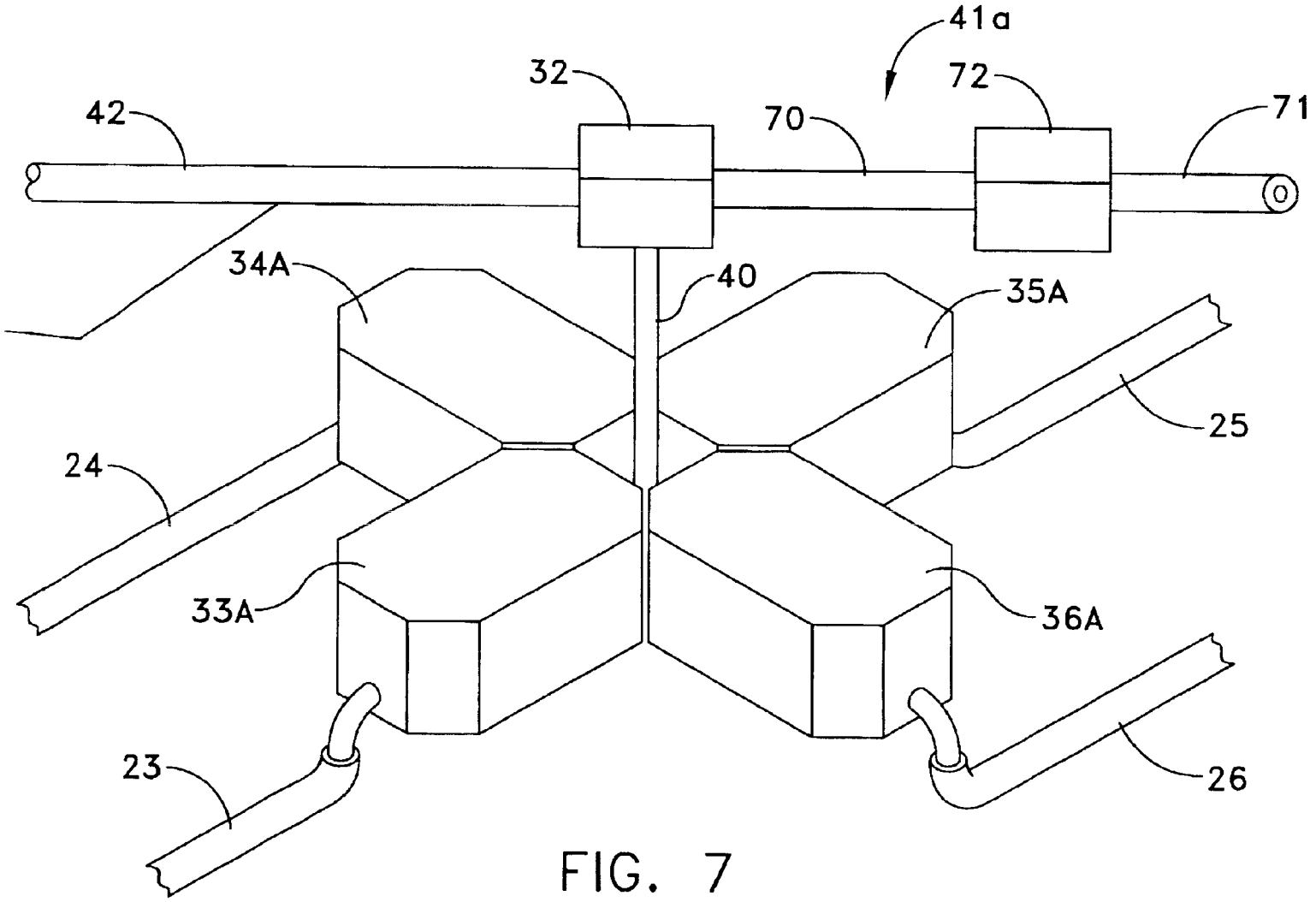
FIG. 7 is a perspective view of the power combiner switch assembly shown in FIGS. 5 and 6.
Figure 8:
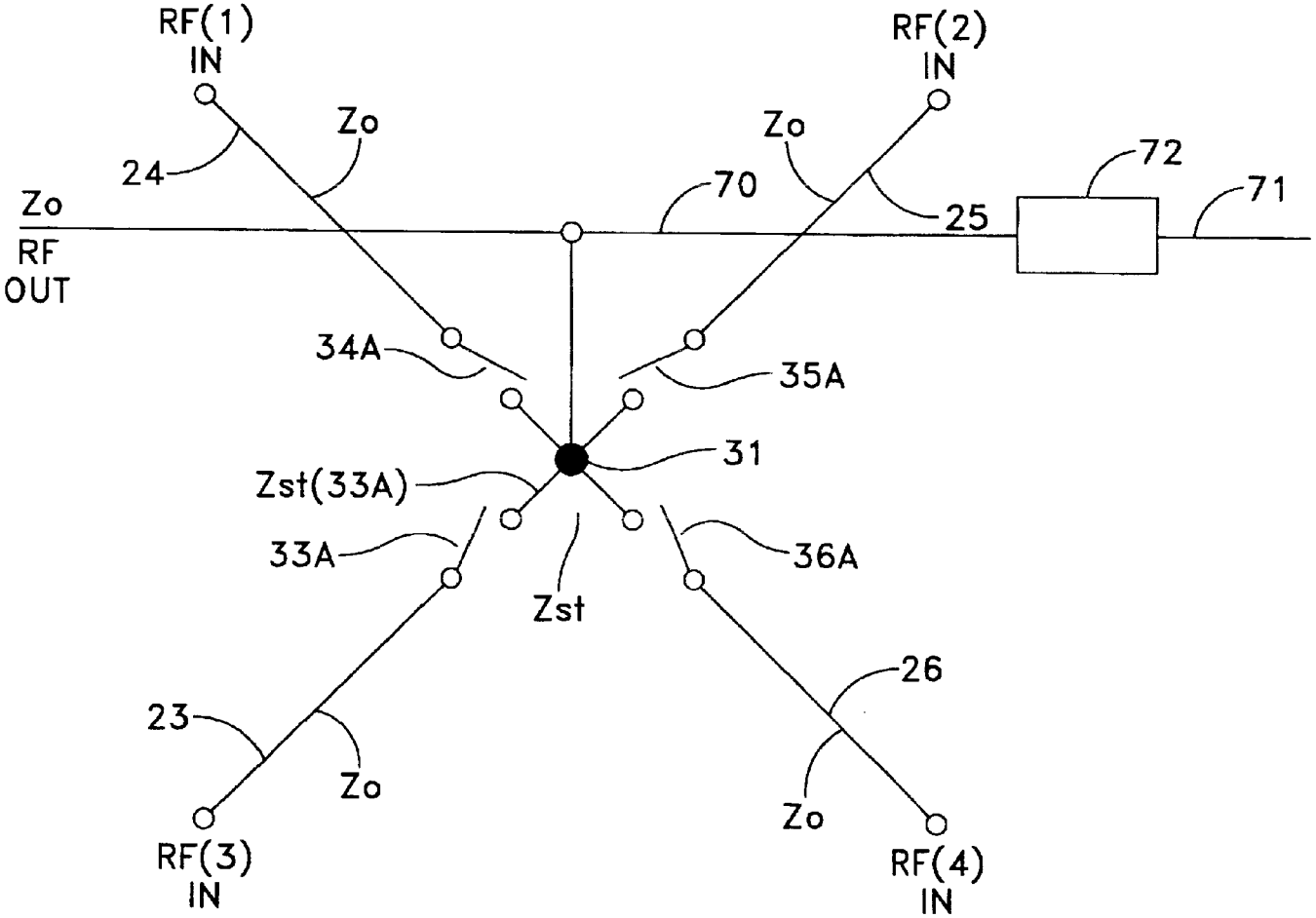
FIG. 8 is an electrical schematic of the power combiner switch assembly shown in FIGS. 5 through 7.

FIGS. 5 through 8 depict a modified power combiner switch assembly 21A that receives signals from transmission lines 23 through 26. The difference in the RF input switches 33A through 36A is more clearly shown in the enlarged view of FIG. 6 that depicts the RF input switch 33A as including a base unit 60 and a stacked solenoid unit 61. The base unit 60 includes end walls 62 and 63 and side walls 64 and 65. Whereas in the embodiment of FIGS. 1 through 3 the RF input switch has a rectangular shape, the switch 33A has an octagonal shape formed by essentially chamfering the corners of the switch housings. For example, a chamfered surface 66 joins the end wall 62 and side wall 65. End walls, such as the end wall 63 on the switch 33A, can be positioned closer to an axis through the common and output nodes 31 and 32. Thus the length of any conductive path stub from the common node is shortened when a corresponding RF input switch is in an open-circuit or non-conductive state. In FIG. 8, this impedance is designated as $Z_{st}$ (33A) for the RF switch 33A. Minimizing this length minimizes any error introduced by assuming that an open RF input switch produces an infinite impedance on the open circuit leg.

Figure 5:
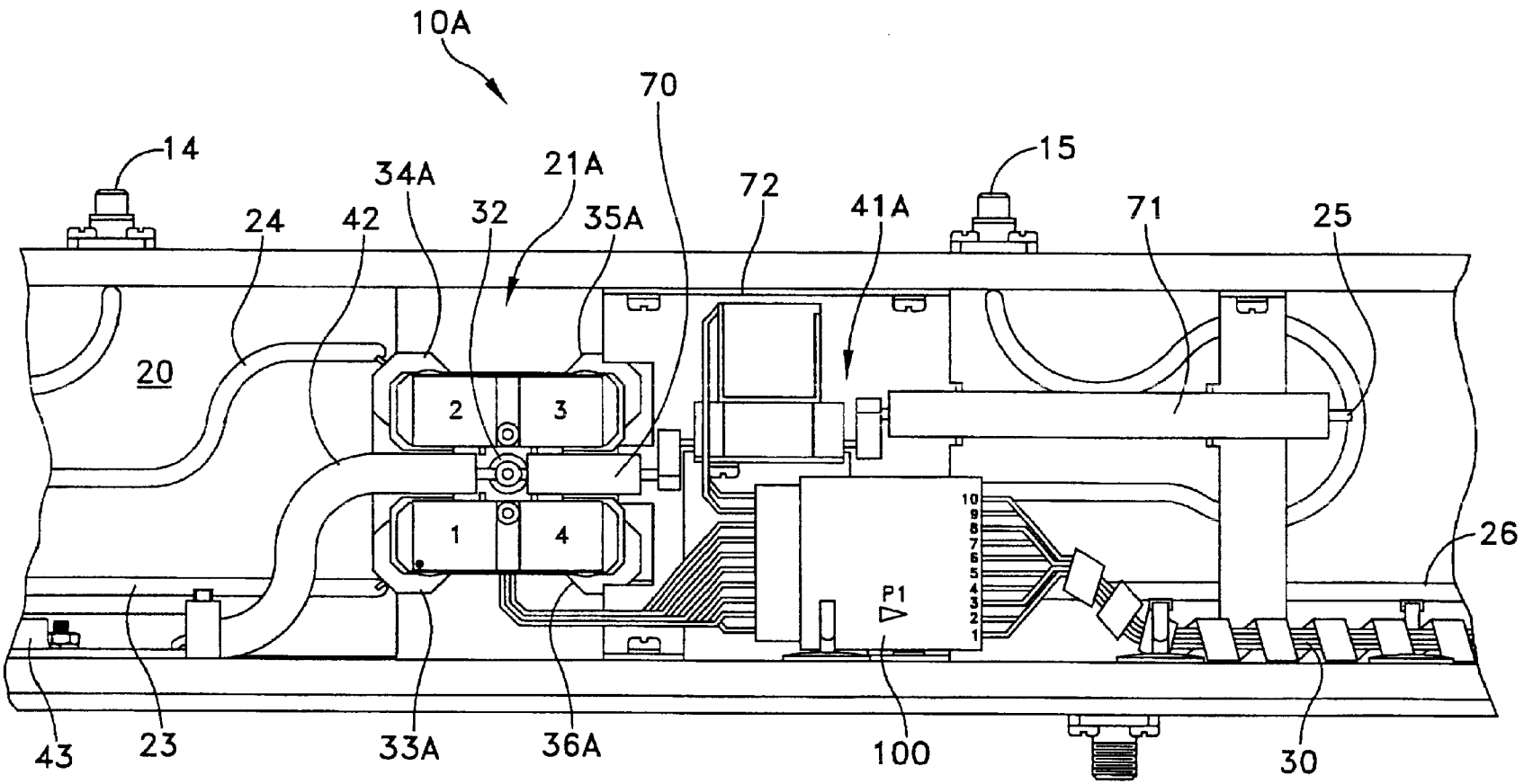
FIG. 5 is a plan view of another embodiment of a power combiner constructed in accordance with this invention.
Figure 6:
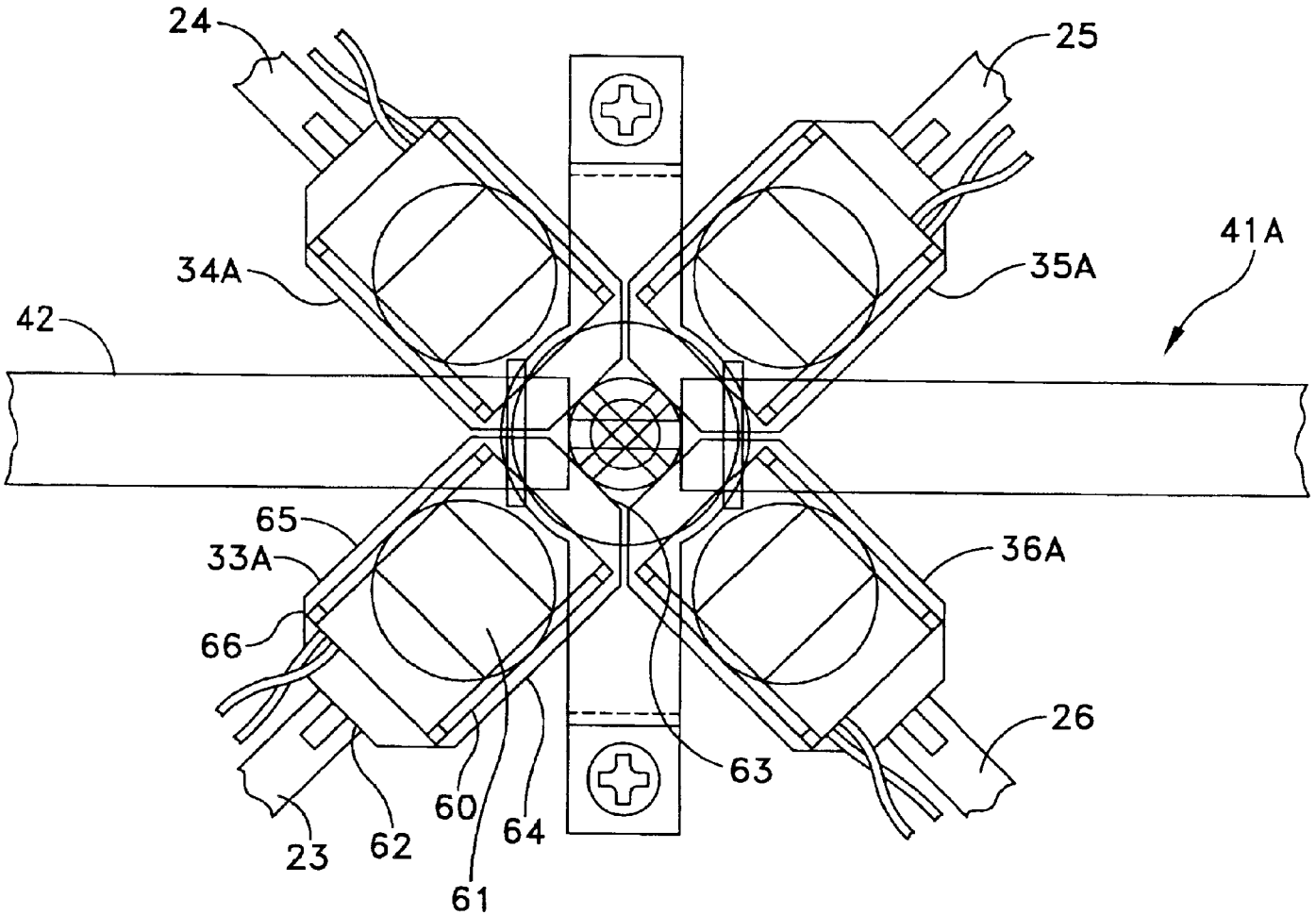
FIG. 6 is an enlarged plan view of a power combiner switch assembly constructed in accordance with this embodiment of the invention.

A further improvement occurs by modifying the construction of the stub 41 in FIGS. 1 through 3 to produce a stub 41A that has a variable length as is more specifically shown in FIGS. 5, 7 and 8. The power combiner switch assembly 21A includes a transmission line 42 which connects the output node 32 to a coupler 43 to the RF output connection 17. A single stub matching circuit includes a transmission line 40 between the common and output modes 31 and 32. However, in this embodiment, the stub 41A comprises two transmission lines 70 and 71 and an intermediate RF control switch 72 to provide a stub with a switchable or variable length. When the RF control switch 72 is not conductive, the stub 41A has an effective length corresponding to the length of the transmission line 70 plus any conductive path in the RF control switch. When the RF control switch 72 is conductive, the stub 41A has an effective length equal to the sum of the length of all the components including the first and second transmission lines 70 and 71, the total conductive path in the RF control switch 72 and any intervening connectors.

The variable length stub 41A enables the definition of two sets of operating conditions. The first involves combinations of three or four simultaneously conductive switches or active inputs (i.e., "3–4 operating modes"); the second set, combinations of one or two active inputs (i.e., a "1–2 operating modes"). Using an analogous analysis to that shown with respect to FIG. 4, for one particular application, the transmission line 40 between the common node 31 and output node 32 was selected to introduce a lagging phase shift of 28° for all operating modes.

In this embodiment establishing the definition of the 3–4 operating modes and 1–2 operating modes and enabling the effective length of the stub 41A to be varied permits an analysis based upon two mean impedance assumptions. That is, it is assumed that the mean impedance is 14 ohms for the 3–4 operating modes and 35 ohms for the 1–2 operating modes. With these specific assumptions, further analysis leads to a requirement for a 52° phase shift during the 3–4 operating modes and a 20° phase shift for the 1–2 operating modes. This enables the physical lengths for the transmission lines 70 and 71 to be determined.

A transmission line that introduces 20° of phase shift is physically very short at the typical operating frequencies; it is less than 2 cm. at 900 MHz. The arrangement of the components in the combiner switch assembly 21A may preclude such close spacing for the RF control switch 72. Thus, in the embodiment of FIGS. 5 through 8, the transmission line 70 has a length that provides a 52° phase shift for the 3–4 operating modes when the RF control switch 72 is open. The transmission line 71 is then selected so that the transmission lines 70 and 71 and the conductive length through the RF control switch have a combined or total length of 200°; that is, the length is the 20° length needed to match impedances in the 1–2 operating modes plus 180°. This increase over the 20° length is one-half wave length, so when the RF control switch 72 is closed the stub 41A has an effective length of 20°.

Figure 9:
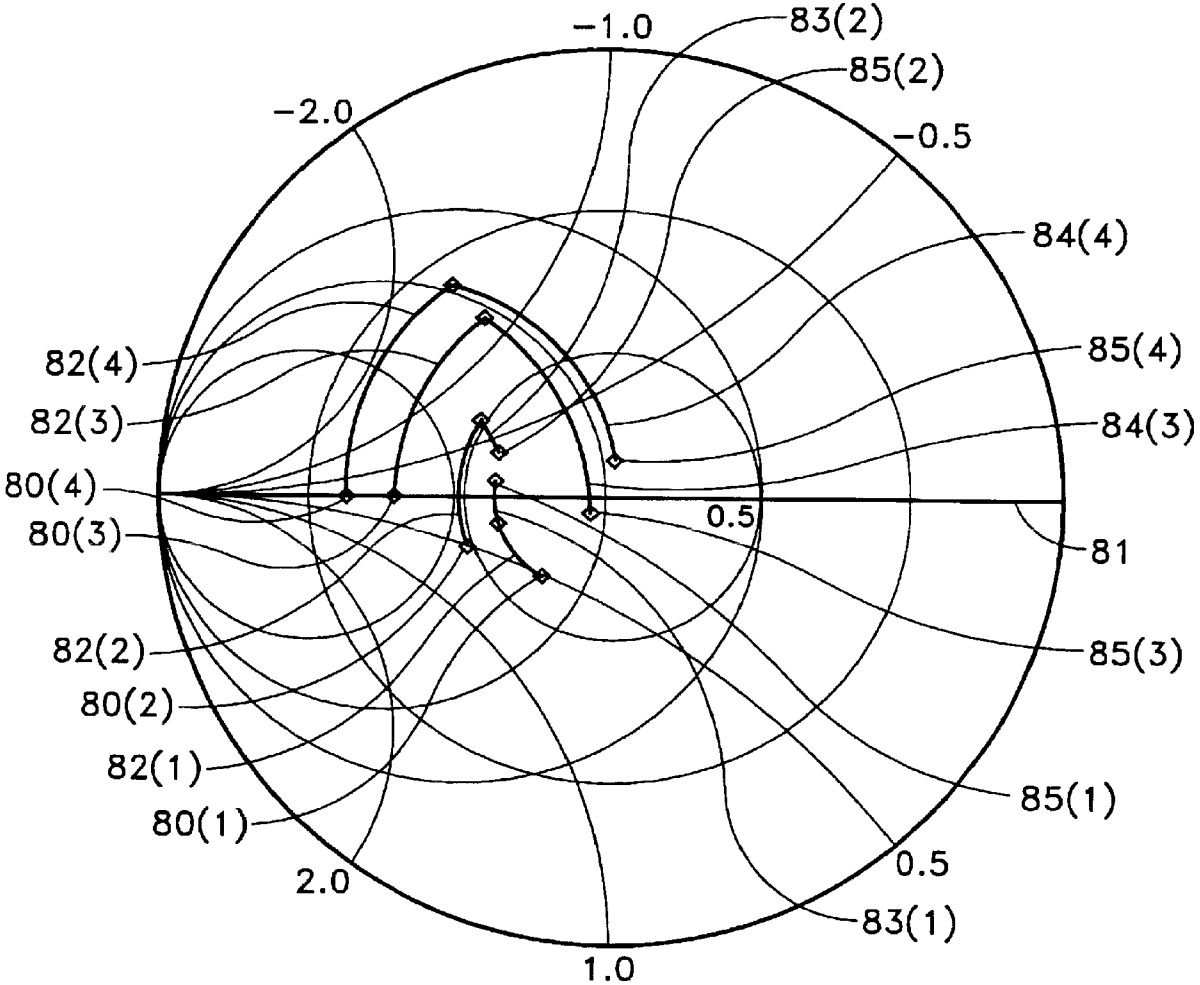
FIG. 9 is a Smith chart that depicts the operation of the embodiment shown in FIGS. 5 through 8.

Points 80(1) through 80(4) in the Smith chart of FIG. 9 represent the common node input impedance for one, two, three and four active simultaneous inputs for a power combiner as shown in FIGS. 5 through 8. The initial points in FIG. 9 are generally closer to the horizontal or real axes of the Smith chart of FIG. 4. This improvement results because the errors in the assumptions introduced by the finite open-circuit stub lengths as represented by $Z_{st}$(33) in FIG. 8 are reduced in that embodiment.

An upward extending arc 82(4) from the point 80(4) represents an impedance change caused by introducing the selected 28° phase delay. It has the same shape and length as the arc 47 in FIG. 4. This an equal delay applied to all the initial points 80(1) through 80(4); they are designated 82(1) through 82(4), respectively.

During the 1–2 operating modes, the RF control switch 72 shifts to a conductive state so the effective length of the stub 41A, including the length of the conductive paths through the transmission lines 70 and 71 and the RF control switch 72, determines the capacitive correction. That is shown by segments 83(1) and 83(2) in FIG. 9 for the curves with initial points 80(1) and 80(2) that represent a 20° phase shift. For 3–4 operating modes, the RF control switch 72 in non-conductive state. The effective length for the stub 41A provides a 52° phase shift represented by the arcs 84(3) and 84(4) related to the starting points 80(3) and 80(4). As a result, the impedance at the output node 32 is transformed by this single stud matching circuit to the four operating points 85(0) through 85(4), respectively.

tests on a particular embodiment of a power combiner 10 with a power combiner switch assembly 21A as show in FIGS. 5 through 8, provides the following results:

| Number of Conductive Inputs | VSWR | Insertion Loss |
|---|---|---|
| 4 | <1.25 | <0.5 dB |
| 3 | <1.3 | <0.5 dB |
| 2 | <1.6 | <0.5 dB |
| 1 | <1.7 | <0.5 dB |

Figure 10:
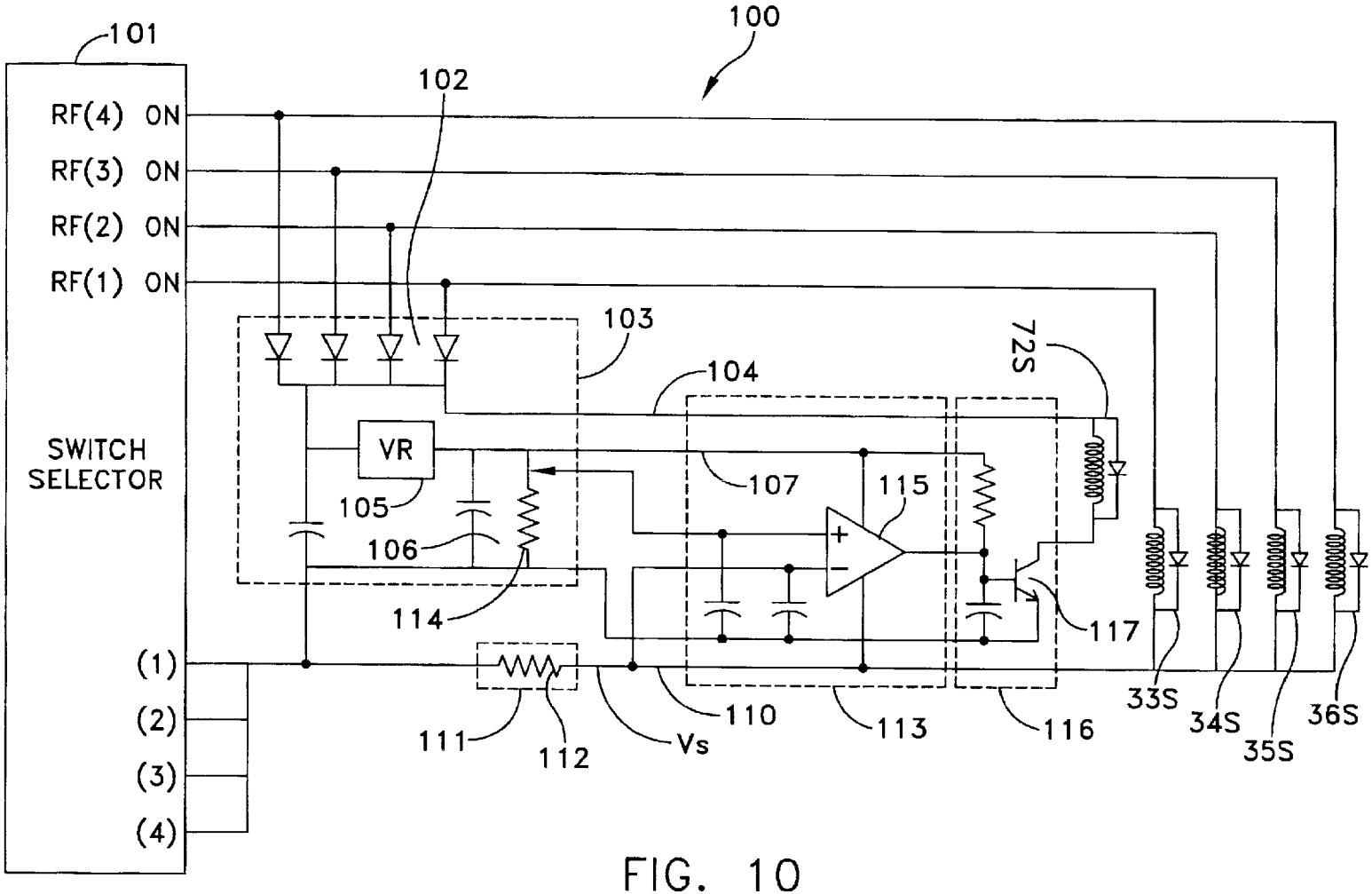
FIG. 10 is an electrical schematic that depicts one embodiment of a control for use with the power combiner switch assembly shown in FIGS. 5 through 8.

FIGS. 10 depicts one embodiment of a control circuit 100 for establishing the conductive state of the RF control switch 72 associated with variable length stub 41A in FIGS. 5 through 8. A switch selector 101 provides various signals through the cable 30 in FIG. 5 to the control circuit 100. These remotely generated selection signals are designated RF(1) through RF(4) signals. Each of the relays in FIG. 10 is designated by reference to its solenoid so the RF(1) through RF(4) signals control the solenoids 33S through 36S, respectively.

Whenever one or more of the remote selection signals from the switch selector 101 is active, one or more diodes 102 in a DC power supply 103 taps that signal or those signals to produce an unregulated voltage on a conductor 104. A conventional voltage regulator circuit 105 and filter circuit 106 produce a regulated power supply voltage on a conductor 107.

Each of the solenoids 33S through 36S connects to a common return 110. A voltage sensor 111, shown as a simple resistor 112, generates a voltage $V_s$ on the return conductor 110 that is proportional to the current in the return conductor 110. As will be apparent, this voltage will step to essentially four different levels depending upon the number of switches that are active.

A comparator circuit 113 receives the $V_s$ signal on conductor 110 and an adjustable set point signal from a potentiometer 114 connected to the regulated power conductor 107. The comparator comprises an open-loop operational amplifier comparator circuit 115 to control the conduction of a driver 116 that includes a transistor 117. The set point 114 is selected so that the voltage $V_{sp} > V_s$ whenever any one or any two of the RF(1) through RF(4) signals are active. Thus, during the 1–2 operating modes the comparator circuit 113 biases the transistor 117 to a conductive state so the driver 116 energizes the solenoid 72S associated with the RF control switch 72. When the signal rises above the set point, as during the 3–4 operating modes, $V_{sp} < V_s$ so the operational amplifier 115 biases the driver 117 to a non-conductive state and shifts the RF control switch 72 to a non-conductive state so only the one transmission line 70 in FIGS. 5 through 8 is included in the stub 41A.

As will be apparent, this control circuit 100 in FIG. 10 is readily adapted for installation in the power combiner as shown in FIG. 5. Moreover, the control circuit does not require any independent power supply, all the power can be readily derived from the signals applied to the solenoids 33S through 36S. Such a circuit can be included within the chassis of the power combiner 10A without any need for shielding. However, shielding is easily achieved by spacing or by conventional shielding techniques.

Figure 11:
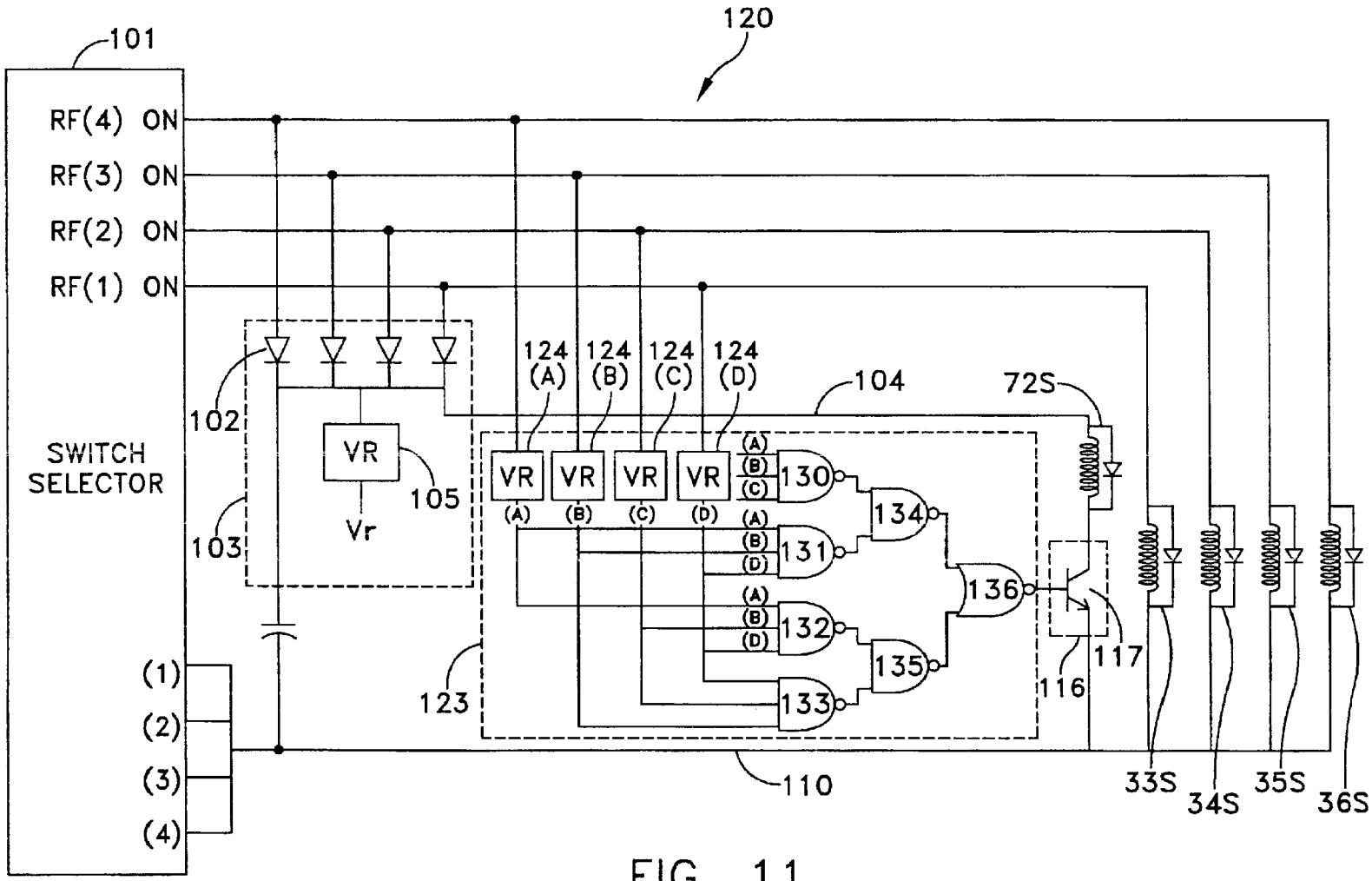
FIG. 11 is another embodiment of a control useful with the power combiner switch assembly shown in FIGS. 5 through 8.

FIG. 11 depicts an alternative, digitally implemented control circuit 120 that can be substituted for the circuit 100 in FIG. 10. As in the control circuit 100 in FIG. 10, the control circuit 120 includes a switch selector 101 that provides the various RF(1) through RF(4) signals through the cable 30 in FIG. 5 to the control circuit 120 and then to the solenoids 33S through 36S, respectively that connect to the common return conductor 110.

Whenever one or more of the RF(1) through RF(4) remote selection signals is active, one or more of the diodes 102 in a DC regulated power supply 103 generates an unregulated voltage on a conductor 104 for energizing the solenoid 72S for the RF control switch.

In this embodiment, a digitally implemented comparator circuit 123 responds to logic level signals indicated the state of each of the RF(1) through RF(4) selection signals. Specifically, voltage regulator circuits are attached to be energized by one of the RF selection signals. As shown in FIG. 11, voltage regulators 124A through 124D generate V(A) through V(D) signals in response to the RF(1) through RF(4) selection signals, respectively.

Each of the V(A) through V(D) signals provides a logical input to one or more NAND gates 130 through 133. Each NAND gate monitors a different one of the possible sets of three of the V(A) through V(D) inputs. Consequently, one or more NAND gates 130 through 133 will shift to an assertive state (i.e., a logic "TRUE" state or a state wherein the output of a NAND gate is "HIGH") only when during the 3–4 operating modes when either three or four RF selection signals are active. For the 1–2 operating modes, none of the NAND gates 130 through 133 will be in an asserted state.

When none of the NAND gates 130 through 133 is asserted, NAND gates 134 and 135 and a NOR gate 135 bias the transistor 117 into a conductive state. This energizes the solenoid 72S. So for the 1–2 operating modes, the entire stub 41A provides impedance matching. For the 3–4 operating modes, the transistor is biased off, so the transmission line 70 in the stub 41A is determinative of the impedance matching. As will be apparent, the comparator circuit 123 uses the NAND gates 130 through 133 to sense the number of RF input switches that are conductive so that the comparator circuit 123 can control the conductive state of the RF control switch 72.

The two basic embodiments of this invention provide improved performance for a power combiner. Specifically, the use of the single stub matching circuit for transforming the impedance at a common node and an output node provides VSWR and insertion loss characteristics that are improved over power combiners that do not incorporate such a structure. Depending upon the stringency of the requirements, a power combiner circuit constructed in accordance with this invention is capable of two embodiments in which a simpler embodiment provides one set of characteristics and another embodiment with a variable length stub satisfies even more stringent requirements.

This invention has also been disclosed with respect to specific embodiments. Both embodiments depict a single stub matching circuit with a transmission line between the common and output nodes that lies along an axis that is orthogonal to the axis the plane of which RF conductors leading to the power combiner switch assembly. The open-loop transmission line operating as a stub from the output node and the output RF conductor are shown in planes that are parallel to the planes of the input conductors. Other angular and other spatial relationships could be implemented. Specific configurations of RF input switches and control switches and other components of a power combiner have been disclosed. Many of these physical characteristics and other elements can also be varied without departing from the spirit and scope of this invention while attaining some or all of the benefits of this invention. Therefore it is the intent of the appended claims to cover all such variations as come within the true spirit and scope of this invention.

What is claimed as new and desired to be secured by Letters Patent of the United States is:

1. A power combiner having a plurality of RF input connections and an RF output connection and comprising:

A) a switched RF feed line from each RF input connection to a common node, each said RF feed line including a transmission line extending from one RF input connection and an RF switch proximate said common node and connected between said transmission line and said common node, said transmission lines lying in a plane B) an RF output conductor having a first end connected to the RF output connection and a second end defining an output node that is spaced from said plane along an axis orthogonal to the plane, and C) an impedance matching network interconnecting said common and output nodes and including a delay line on the axis between the common and output nodes and a capacitive stub extending from said output node parallel to the plane.

2. A power combiner as recited in claim 1 wherein each said RF switch is a remotely operated single-pole switch and said power combiner additionally includes connections for enabling the independent operation of said RF switches.

3. A power combiner as recited in claim 1 wherein said capacitive stub has a variable length.

4. A power combiner as recited in claim 3 wherein said capacitive stub includes first and second transmission lines and an intermediate control switch whereby said delay line and capacitive stub operate with different impedance matching characteristics depending upon the conductive state of said control switch.

5. A power combiner as recited in claim 4 additionally comprising a circuit that establishes the conductive state of said control switch in response to the number of RF switches that are closed.

6. A power combiner for producing at an RF output connection the sum of up to four RF inputs applied to RF input connections in response to remotely generated selection signals, said power combiner comprising:

A) a common node,

B) a transmission line and RF input switch in series between each RF input connection and said common node with said RF input switch being proximate said common node and said transmission lines lying in a plane, C) an output node spaced from said plane, D) an RF transmission line connecting said output node to the RF output connection, and E) a single stub matching circuit connected to said common and output nodes including a delay line extending between the common and output nodes along an axis orthogonal to said plane and a capacitive stub extending from the output node parallel to said plane thereby to establish an impedance transformation function between said common and output nodes.

7. A power combiner as recited in claim 6 wherein said capacitive stub includes first and second transmission lines and an intermediate RF control switch whereby the conductive state of said RF control switch determines the effective length of said stub.

8. A power combiner as recited in claim 7 wherein the operation of said power combiner is characterized by a first operating mode when one or two of said RF input switches are closed and a second operating mode with three or four of said RF input switches are closed and wherein said RF control switch has first and second effective conductor lengths in the non-conductive and conductive states respectively, the combined lengths of said first transmission line and switch conductor length in the non-conductive state being selected to provide an impedance match for one of said operating modes and the combined lengths of said first and second transmission lines and said switch conductor length in the conductive state being selected to provide an impedance match for the other of said operating modes.

9. A power combiner as recited in claim 7 for operating at a predetermined frequency wherein the effective length of said stub means when said RF control switch is conductive is the sum of the a physical length selected for one of the impedance matching conditions and a physical length corresponding to one-half wavelength at the predetermined frequency.

10. A power combiner as recited in claim 7 additionally comprising means for controlling the conductive state of said RF control switch in response to the number of said RF input switches that are simultaneously conductive.

11. A power combiner as recited in claim 10 wherein said controlling means for said RF control switch includes:

i) power input means for obtaining power from the remotely generated selection signals, ii) means for sensing the number of RF input switches that are in the conductive state, and iii) means for controlling the conductive state of said RF control switch in response to said sensing means.

12. A power combiner as recited in claim 11 wherein said sensing means includes a digital gating circuit for determining the number of active RF input switches.

13. A power combiner as recited in claim 12 wherein said control means includes an unregulated supply that receives each of the selection signals in parallel and a regulated supply connected to said unregulated supply, said sensing means and said controlling means.

* * * * *